US011154139B2

(12) United States Patent
Ge

(10) Patent No.: US 11,154,139 B2
(45) Date of Patent: Oct. 26, 2021

(54) FITNESS STOOL

(71) Applicant: Zhuhai Shiqiang Technology Development Co.,Ltd., Guangdong (CN)

(72) Inventor: Zhicheng Ge, Guangdong (CN)

(73) Assignee: ZHUHAI SHIQIANG TECHNOLOGY DEVELOPMENT CO., LTD., Zhuhai (CN)

( * ) Notice: Subject to any disclaimer, the term of this patent is extended or adjusted under 35 U.S.C. 154(b) by 0 days.

(21) Appl. No.: 16/155,797

(22) Filed: Oct. 9, 2018

(65) Prior Publication Data

US 2019/0038034 A1 Feb. 7, 2019

Related U.S. Application Data

(63) Continuation of application No. PCT/CN2018/000002, filed on Jan. 2, 2018.

(30) Foreign Application Priority Data

Feb. 13, 2017 (CN) ..... 201710076971.8
Sep. 6, 2017 (CN) ..... 201710793874.0

(51) Int. Cl.

| | |
|---|---|
| ***A47C 9/00*** | (2006.01) |
| ***A63B 23/04*** | (2006.01) |
| ***A63B 23/035*** | (2006.01) |
| ***A63B 21/04*** | (2006.01) |
| ***A63B 21/00*** | (2006.01) |

(Continued)

(52) U.S. Cl.

CPC ..... *A47C 9/002* (2013.01); *A63B 21/04* (2013.01); *A63B 21/045* (2013.01); *A63B 21/068* (2013.01); *A63B 21/4031* (2015.10); *A63B 21/4045* (2015.10); *A63B 23/03525* (2013.01); *A63B 23/04* (2013.01);

(Continued)

(58) Field of Classification Search

CPC ..... A63G 13/04; A63G 31/06; A63G 31/08
See application file for complete search history.

(56) References Cited

U.S. PATENT DOCUMENTS 517,403 A * 3/1894 Bradish, et al. ..... B62K 9/02 280/87.03
1,527,451 A * 2/1925 Thalken ..... A63B 5/10 482/128

(Continued)

FOREIGN PATENT DOCUMENTS

DE 29614210 U1 * 10/1996
DE 29706557 U1 * 8/1997

(Continued)

*Primary Examiner* — David E Allred

(74) *Attorney, Agent, or Firm* — Hemisphere Law, PLLC; Zhigang Ma

(57) ABSTRACT

A fitness stool includes a sliding system, a support and connection frame and an elastic device. One end of the sliding system is inserted into and fixed to the ground of the earth and the other end of the sliding system is connected with the support and connection frame. The support and connection frame can be moved upwards and downwards relative to the ground, and the sliding system comprises a sliding rod and a sliding cavity. The elastic device realizes elastic damping and elastic return between the ground and the support and connection frame.

6 Claims, 11 Drawing Sheets

(51) Int. Cl.
*A63B 21/068* (2006.01)
*A63B 21/045* (2006.01)
*A63B 71/02* (2006.01)

(52) U.S. Cl.
CPC ..... *A63B 21/4027* (2015.10); *A63B 2071/025* (2013.01); *A63B 2208/0228* (2013.01)

(56) References Cited

U.S. PATENT DOCUMENTS 1,832,755 A * 11/1931 Waddell ..... A63G 11/00 472/4
2,527,763 A * 10/1950 Probst ..... A63G 11/00 472/4
2,709,079 A * 5/1955 Bubb ..... A63G 11/00 267/174
2,726,085 A * 12/1955 Brand ..... A63G 11/00 472/4
2,735,679 A * 2/1956 Mortenson ..... A63G 11/00 472/4
2,847,217 A * 8/1958 Adams ..... A63B 25/08 482/128
2,978,245 A * 4/1961 Rempel ..... A63G 13/08 472/105
2,999,688 A * 9/1961 Gabrielson ..... A63G 13/08 472/25
3,032,342 A * 5/1962 Glass ..... A63G 13/08 472/105
3,062,542 A * 11/1962 Evancha ..... A63B 5/08 482/34
3,167,312 A * 1/1965 Blanchard ..... A63B 25/08 482/128
3,292,924 A * 12/1966 Wormser ..... A63G 11/00 472/113
3,494,613 A * 2/1970 Hatfield ..... A63G 13/04 472/135
3,726,521 A * 4/1973 Sidlauskas ..... A63G 1/12 472/33
3,915,451 A * 10/1975 Adams ..... A63B 25/08 482/23
4,341,377 A * 7/1982 Ahrens ..... A63G 11/00 472/113
4,438,919 A * 3/1984 Gamzo ..... A63B 69/0022 280/87.03
4,645,197 A * 2/1987 McFee ..... A63B 5/08 482/112
4,693,466 A * 9/1987 Swengel, Sr. ..... A63G 13/08 472/105
5,407,246 A * 4/1995 Meeker ..... A47D 13/107 297/137
5,700,201 A * 12/1997 Bellows ..... A47D 13/107 297/137
5,733,225 A * 3/1998 Watermiller ..... A63B 9/00 472/137
5,776,003 A * 7/1998 Kenny ..... A63B 5/11 472/105
5,934,747 A * 8/1999 Garland ..... A47D 11/00 297/136
6,077,205 A * 6/2000 Zarillo ..... A63B 23/0211 482/121
6,375,599 B1 * 4/2002 Brown ..... A47D 1/00 297/137
6,379,256 B1 * 4/2002 Gatto ..... A63G 11/00 472/109
7,032,972 B2 * 4/2006 Berman ..... A47C 7/14 297/313
9,615,673 B2 * 4/2017 Burns ..... A47D 13/107
10,021,994 B1 * 7/2018 Lu ..... A47D 13/043
2002/0164917 A1 * 11/2002 Keegan ..... A47D 13/107 446/71
2005/0187072 A1 * 8/2005 Solinas ..... A63B 22/0076 482/57
2008/0113581 A1 * 5/2008 Jazenski ..... A63H 33/006 446/227
2010/0159428 A1 * 6/2010 Grasing ..... A47D 13/105 434/258
2011/0281694 A1 * 11/2011 Vujicic ..... A63B 21/225 482/63
2013/0123074 A1 * 5/2013 Jun ..... A63B 21/00196 482/57
2014/0329652 A1 * 11/2014 Oh ..... A61H 1/0237 482/142
2019/0262660 A1 * 8/2019 Kim ..... A63B 22/0056

FOREIGN PATENT DOCUMENTS

DE 20000404 U1 * 4/2000
EP 0140306 A2 * 5/1985
FR 2545729 A1 * 11/1984

* cited by examiner

FITNESS STOOL

FIELD OF THE INVENTION

The invention relates to an exercise equipment for fitness, which can be used for indoor fitness or as a fitness path, a park stool, etc., in particular, to a fitness stool.

BACKGROUND OF THE INVENTION

With the improvement of people's self-cultivation and living standards, sports and fitness has become an indispensable portion of people's daily life. Chinese invention patent application CN102319507B (publication number), CN2011102560273 (application number) provides "a jump type exercise facility", but the following technical features are not disclosed in its technical solutions and technical features:

1. "The support and connection frame is relatively restrained with the ground by the sliding system, so that the support and connection frame can be moved upwards and downwards relative to the ground."

2. "The elastic device that plays the role of elastic damping and elastic reset is arranged between the ground and the support and connection frame."

Therefore, similar product in the prior art has the following defects when used for indoor and outdoor fitness or as park stools:

1. It can jump both upwards and downwards and can translate leftwards and rightwards, so that the freedom degree for movement is too large to be relatively unstable:

2. It does not have any relatively fixed measures, so it will shift and be easily moved by people causing management difficulties and loss of the facility.

When used for indoor and outdoor fitness or as park stools, the fitness equipment in the prior art may move relatively unstably and move around due to a large degree of freedom, causing difficulty in management and loss of the facility. However, such problems may be solved by addition of the above two technical solutions and technical features.

SUMMARY OF THE INVENTION

In view of this, the present invention provides a fitness stool.

In order to achieve the above object, the present invention provides a fitness stool, which mainly includes a sliding system, a support and connection frame and an elastic device. The support and connection frame is relatively restrained with the ground by the sliding system. The support and connection frame can be moved upwards and downwards relative to the ground. The sliding system includes a sliding rod and a sliding cavity, and the elastic device for elastic damping and elastic return is provided between the ground and the support and connection frame.

Further, the support and connection frame is rotatably connected with a left wing plate and a right wing plate. The left wing plate, the right flap plate and the support and connection frame are rotatable relative to each other. A pulley device or a linkage mechanism is disposed between the left and the right wing plates and the ground, and the left wing plate and the right wing plate are respectively provided with a footrest device.

Further, one end of the linkage mechanism is hinged at the left wing plate or the right wing plate and the other end of the linkage mechanism is hinged to the ground.

Further, the sliding system is provided with an upper limit device for preventing the support and connection frame from coming off and a lower limit device for preventing the support and connection frame from colliding with ground.

Further, an upper portion of the support and connection frame is provided with a seat cushion and a handle.

Since the invention adopts the above technical solution, the fitness stool has the advantages that the structure is firm and robust, has more stable movement, will not shift around or easily moved by people and get lost, and thus the management thereof is easy.

REFERENCE NUMERALS IN THE DRAWINGS

1—ground; 2—left wing plate; 2A—left wing plate upper sleeve; 2B—left wing plate lower shaft; 2C—left wing plate upper shaft; 3—footrest device; 4—first torsion spring; 5—support and connection frame; 5A—handle; 5B—support and connection frame main hole; 6—seat cushion; 7—second torsion spring; 8—right wing plate; 8A—right wing plate upper shaft; 8B—spacer sleeve; 8C—shaft—locking clamp; 8D—right wing plate lower shaft; 9—pulley device; 10—spring; 11—connecting seat; 12—sliding system; 12A—sliding cavity; 12B—sliding rod; 12C—lower limit upper portion; 12D—lower limit lower portion; 12E—upper limit upper portion; 12F—upper limit lower portion; 13—linkage mechanism; 14—elastic device.

DETAILED DESCRIPTION OF ILLUSTRATED EMBODIMENTS

Embodiment 1

The present invention will be further described in conjunction with the embodiments and the accompanying drawings, and the following description of the invention is not intended to limit the protection scope of the invention.

Figure 1:
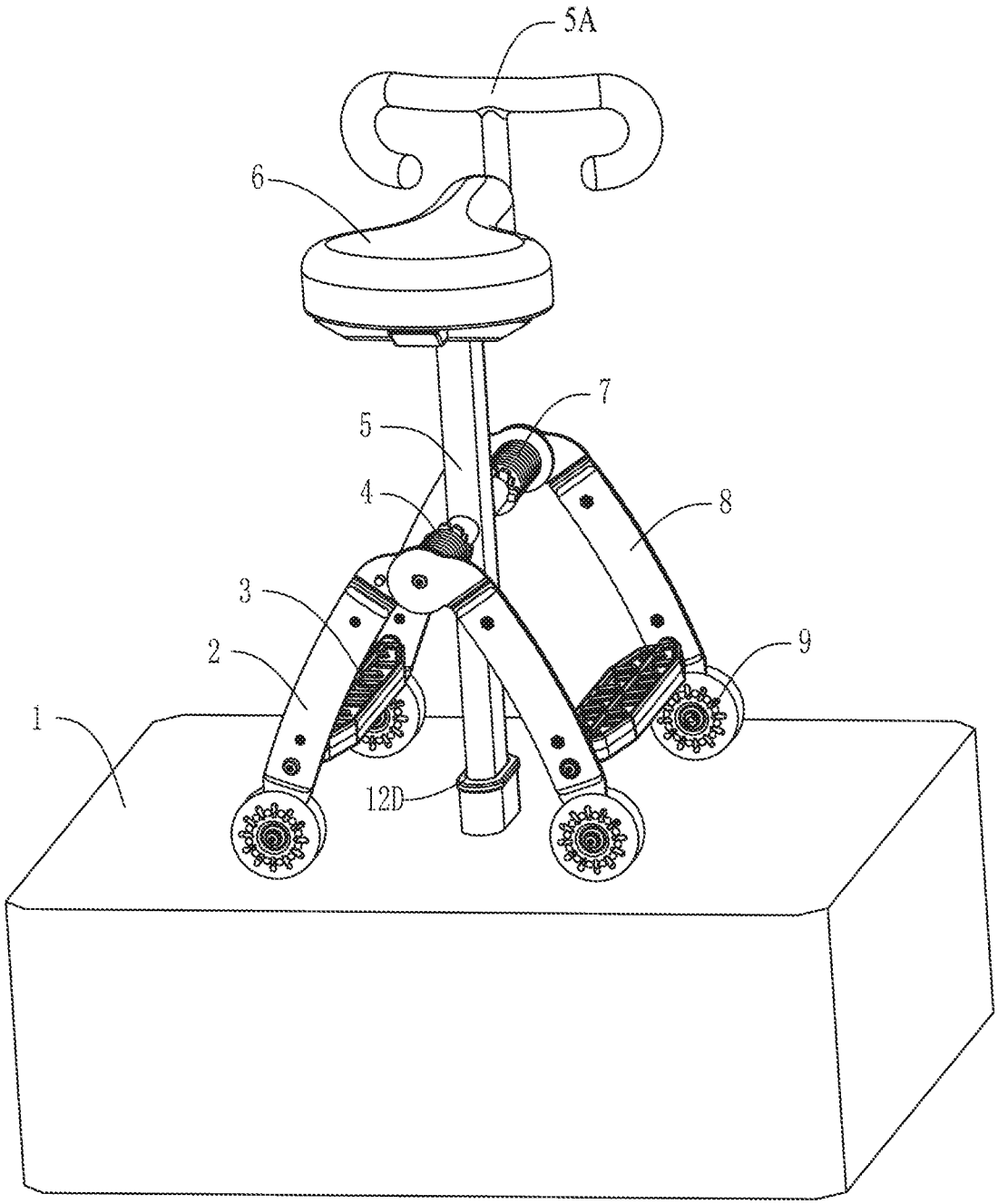
FIG. 1 is a general assembly drawing of embodiment 1 of the present invention.
Figure 2:
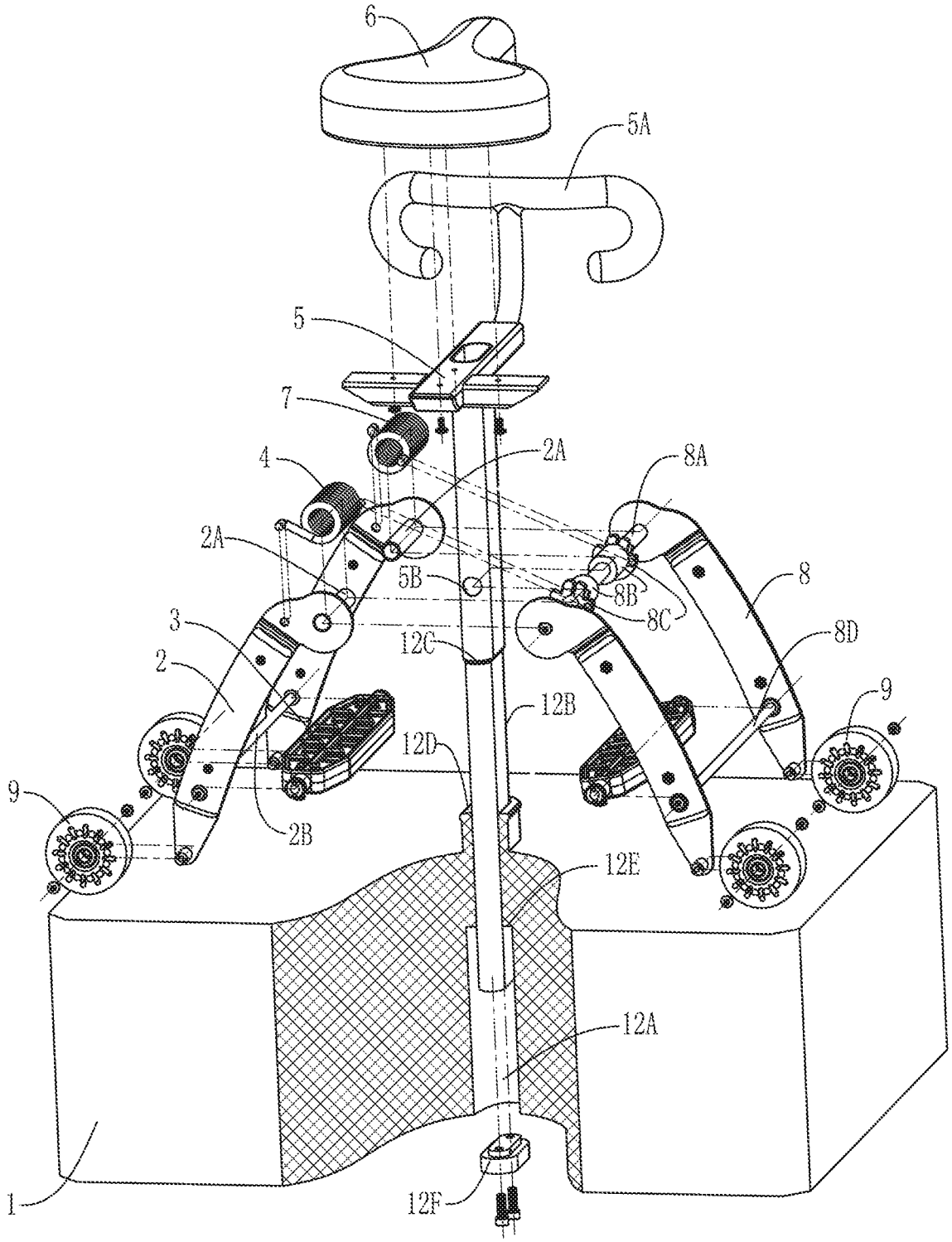
FIG. 2 is an exploded view of embodiment 1 of the present invention.
Figure 3:
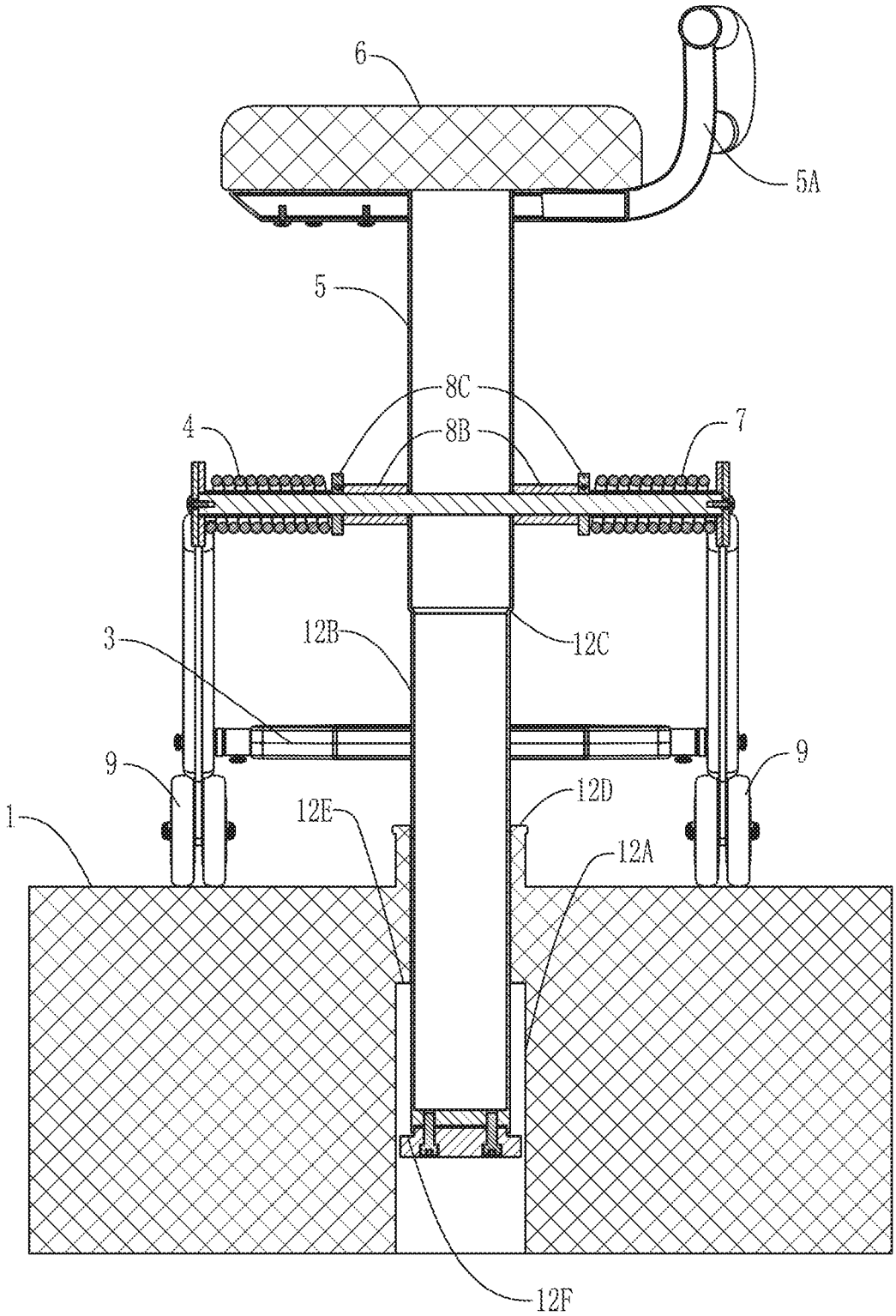
FIG. 3 is a cross-sectional view of embodiment 1 of the present invention.

As shown in FIGS. 1, 2 and 3, the "fitness stool" of the present invention mainly includes a support and connection frame 5, a handle 5A, a seat cushion 6, a left wing plate 2, a footrest device 3, a torsion spring, a right wing plate 8, and a pulley device 9. The ground 1 is provided with a sliding cavity 12A through which a sliding rod 12B disposed at a lower portion of the support and connection frame 5 passes, a lower limit lower portion 12D for preventing the support and connection frame 5 from colliding downwards with ground, and an upper limit upper portion 12E for preventing the support and connection frame 5 from coming off. An upper end of the support and connection frame 5 is provided with a seat cushion 6 and a handle 5A a lower portion is provided with a sliding rod 12B, and a middle portion is provided with a set of support and connection frame main holes 5B. A top end of the sliding rod 12B is provided with a lower limit upper portion 12C for preventing the support and connection frame 5 from colliding with ground, and a bottom end is provided with an upper limit lower portion 12F for preventing the support and connection frame 5 from coming off. The left wing plate 2 is composed of two legs (on both sides), a left wing plate upper sleeve 2A and a left wing plate lower shaft 2B, and the left wing plate lower shaft 2B is rotatably connected with the footrest device 3. The right wing plate 8 is composed of two legs (on both sides), a fixedly connected right wing plate upper shaft 8A and a right wing plate lower shaft 8D, the right wing plate upper shaft 8A is provided with two partition sleeves 8B and two shaft-locking clamps 8C, where the two shaft-locking clamps 8C are respectively fixedly connected to the right wing plate upper shaft 8A by bolts, the two shaft-locking clamps 8C are respectively provided with a hole for the torsion spring handle to be inserted into, and the right wing plate lower shaft 8D is rotatably connected with the footrest device 3. The right wing plate 8 is rotatably connected to the support and connection frame 5 via the right wing plate upper shaft 8A through the support and connection frame main hole 5B. The left wing plate 2 is inserted into the right wing plate upper shaft 8A through the left wing plate upper sleeve 2A and is rotatably connected to the right wing plate 8 and the support and connection frame 5, and it is ensured that the left wing plate 2 and the right wing plate 8 and the support and connection frame 5 can be rotated relative to each other. The first torsion spring 4 is screwed clockwise to sleeve on the left wing plate upper sleeve 2A of the rear end, a handle of one end thereof passes into a hole provided on a rear leg of the left wing plate 2, and a handle of the other end thereof passes into a hole provided in the shaft-locking clamp 8C fixed at the rear end of the right wing plate upper shaft 8A The second torsion spring 7 is screwed counter-clockwise to sleeve on the left wing plate upper sleeve 2A at the front end, a handle of one end thereof passes into a hole provided on a front leg of the left wing 2, and a handle of the other end thereof passes into a hole provided in the shaft-locking clamp 8C fixed at the front end of the right wing plate upper shaft 8A for elastic return. The support and connection frame 5 passes into the sliding cavity 12A through the sliding rod 12B, and the lower limit lower portion 12D disposed on the ground 1 and the lower limit upper portion 12C disposed at a top end of the sliding rod 12B constitute a lower limit device for limiting over-sinking to collide with ground of the support and connection frame 5. The upper limit upper portion 12E provided on the ground 1 and the upper limit lower portion 12F disposed at a bottom end of the sliding rod 12B constitute an upper limit device for limiting excessively rising and disengaging of the support and connection frame 5, so that the body is relatively fixed on the ground 1, where the sliding cavity 12A, the sliding rod 12B, the lower limit upper portion 12C, the lower limit lower portion 12D, the upper limit upper portion 12E, and the upper limit lower portion 12F constitute a sliding system, which enables the support and connection frame 5 to be moved upwards and downwards relative to the ground 1 and ensures that the pulley device 9 can roll on the ground 1. In this system, the left wing plate 2, the torsion spring, the shaft-locking clamp 8C, the right wing plate upper shaft 8A, the right wing plate 8, the pulley device 9 constitutes an elastic device, which realizes an elastic damping on the mechanical relationship between the support and connection frame 5 and the ground 1 and an elastic return on the positional relationship, achieves fitness by motion upwards and downwards, and prevents the facility from shifting around to facilitate management thereof.

Embodiment 2

Figure 4:
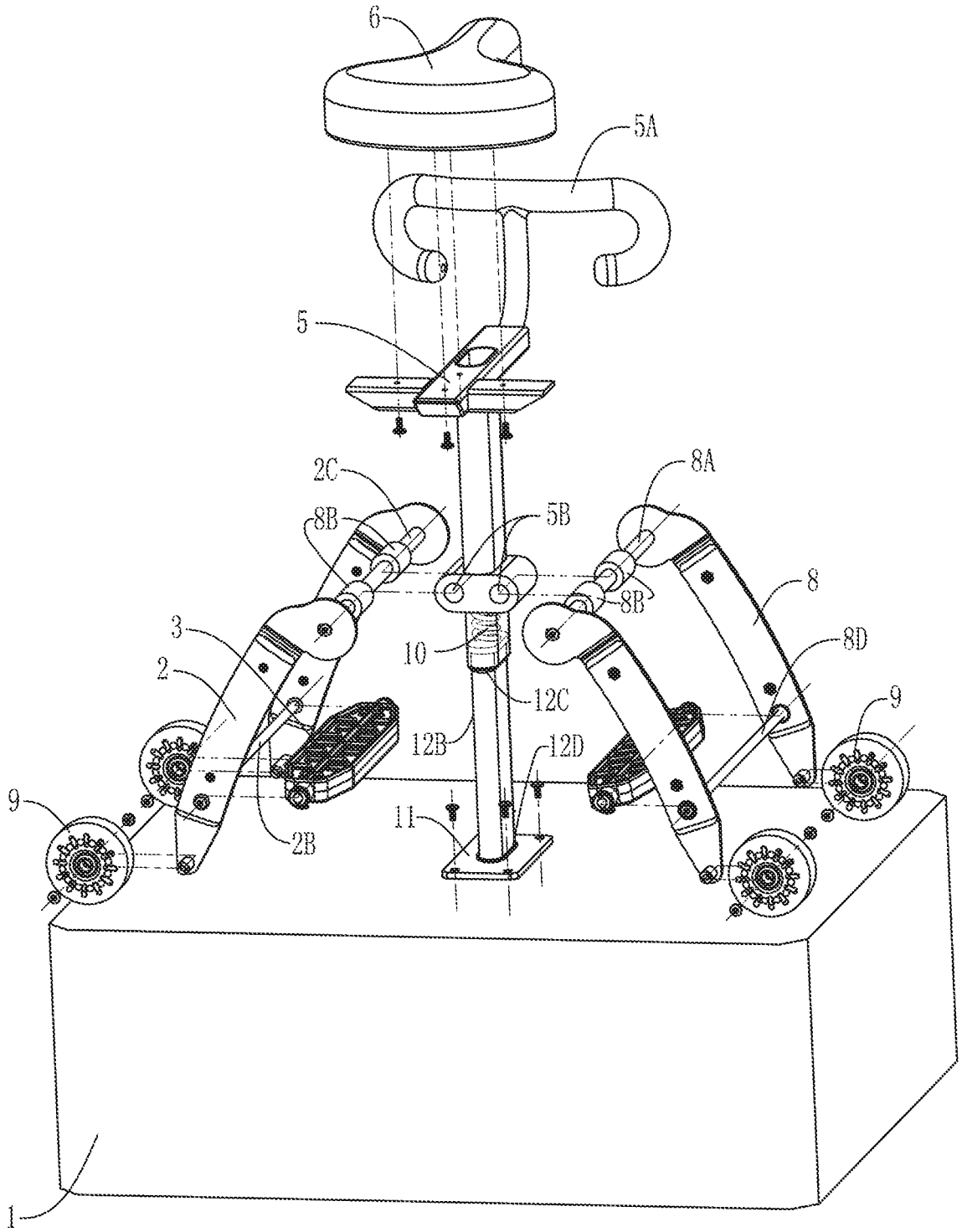
FIG. 4 is an exploded view of embodiment 2 of the present invention.
Figure 5:
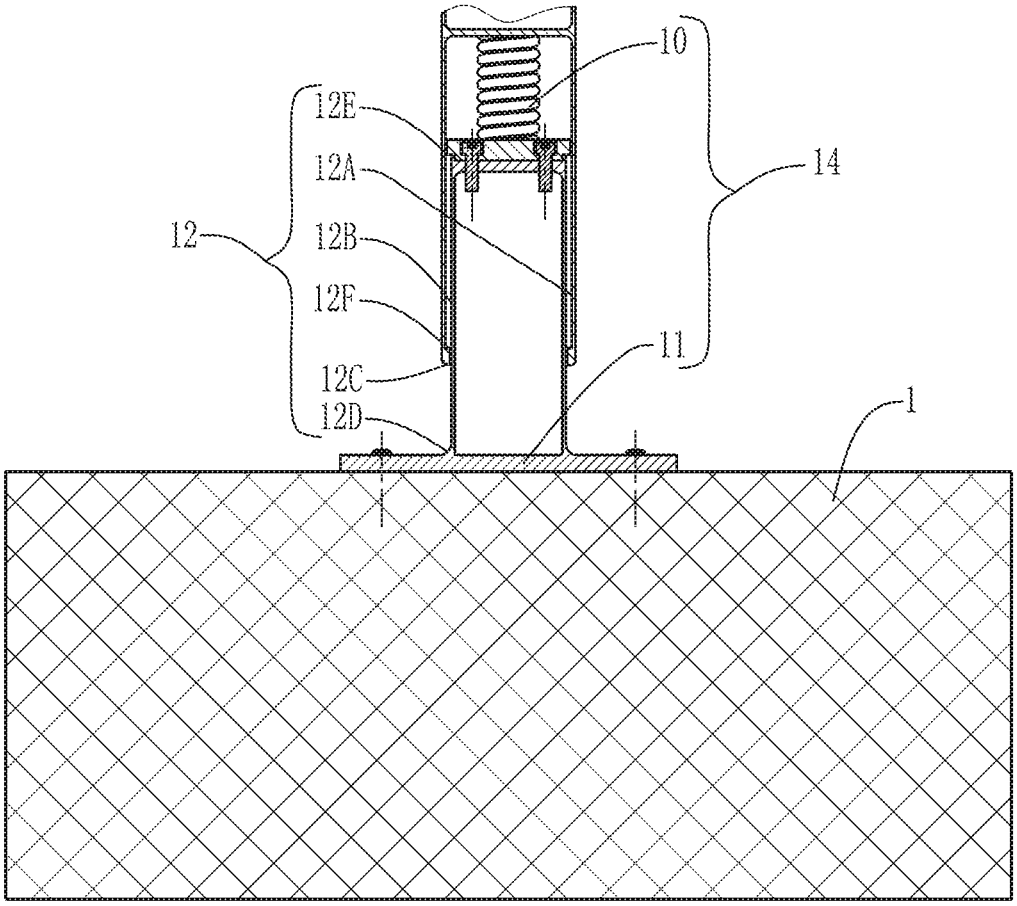
FIG. 5 is a cross-sectional view of a sliding system and an elastic device of embodiment 2 and embodiment 4 of the present invention.

As shown in FIGS. 4 and 5, the "fitness stool" of the present invention mainly includes a support and connection frame 5, a left wing plate 2, a footrest device 3, a right wing plate 8, a pulley device 9, a spring 10, and a connecting seat 11. The ground 1 is fixed with the connecting seat 11 by bolts, the connecting seat 11 is provided with a sliding rod 12B, the bottom of the sliding rod 12B is provided with a lower limit lower portion 12D, and the top of the sliding rod 12B is provided with an upper limit upper portion 12E. An upper portion of the support and connection frame is provided with a handle 5A and a seat cushion 6, and an inner portion is thereof is provided with is provided with a sliding cavity 12A through which a sliding rod 12B passes, a lower limit upper portion 12C for preventing the support and connection frame 5 from colliding downwards with ground, and an upper limit lower portion 12F for preventing the support and connection frame 5 from coming off. Two sides of the support and connection frame 5 are provided with two parallel sets of support and connection frame main holes 5B. The left wing plate 2 is composed of two legs (on both sides), a left wing plate upper shaft 2C and a left wing plate lower shaft 2B, the left wing plate upper shaft 2C is provided with two partition sleeves 8B, and the left wing plate lower shaft 2B is rotatably connected with the footrest device 3. In order to prevent injury of the foot of a rider, an angle control device is disposed between the left wing plate 2 and the footrest device 3 to limit their relative rotation within a certain angle range. The right wing plate 8 is composed of two legs (on both sides), a right wing plate upper shaft 8A and a right wing plate lower shaft 8D, the right wing plate upper shaft 8A is provided with two partition sleeves 8B, the right wing plate lower shaft 8D is rotatably connected with the footrest device 3. An angle control device is disposed between the right wing plate 8 and the footrest device 3 to limit their relative rotation within a certain angle range. The right wing plate 8 is rotatably connected to the support and connection frame 5 via the right wing plate upper shaft 8A through the support and connection frame main hole 5B. The left wing plate 2 is inserted into the right wing plate upper shaft 8A through the left wing plate upper sleeve 2A and is rotatably connected to the right wing plate 8 and the support and connection frame 5, and in this way, the left wing plate 2 and the right wing plate 8 and the support and connection frame 5 can be rotated relative to each other. The connecting seat 11 is inserted into the sliding cavity 12A and connected to the support and connection frame 5 through the sliding rod 12B. The lower limit lower part 12D provided on the connection seat 11 and the lower limit upper part 12C at the lower end of the support and connection frame 5 constitute a lower limit device for limiting excessively rising and disengaging of the support and connection frame 5. The upper limit upper part 12E provided on the connection seat 11 and the upper limit lower portion 12F at the lower end of the sliding cavity 12A constitute an upper limit device for restricting the support and connection frame 5 from excessively rising and disengaging, so that the body is relatively fixed on the ground 1, where the sliding cavity 12A, the sliding rod 12B, the lower limit upper portion 12C, the lower limit lower portion 12D, the upper limit upper portion 12E, and the upper limit lower portion 12F constitute a sliding system, which enables the support and connection frame 5 to be moved upwards and downwards relative to the ground 1 and ensures that the pulley device 9 can roll on the ground 1. In this system, the spring 10, the connecting seat 11 constitutes the elastic device 14, which realizes an elastic damping on the mechanical relationship between the support and connection frame 5 and the ground 1 and an elastic resting-return on the positional relationship, achieves fitness by motion upwards and downwards, and prevents the facility from shifting around to facilitate management thereof Embodiment 3

Figure 6:
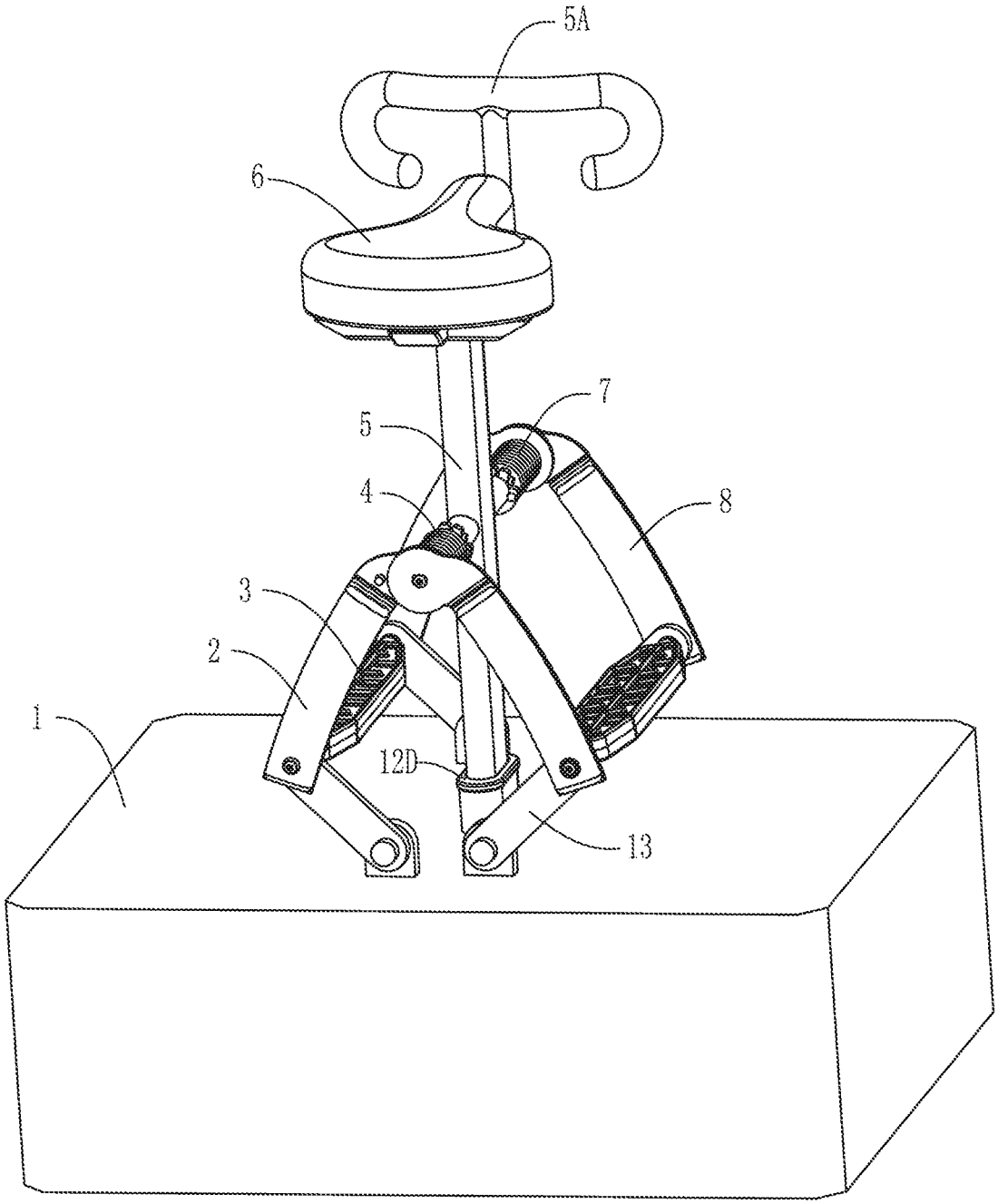
FIG. 6 is a general assembly view of embodiment 3 of the present invention.
Figure 7:
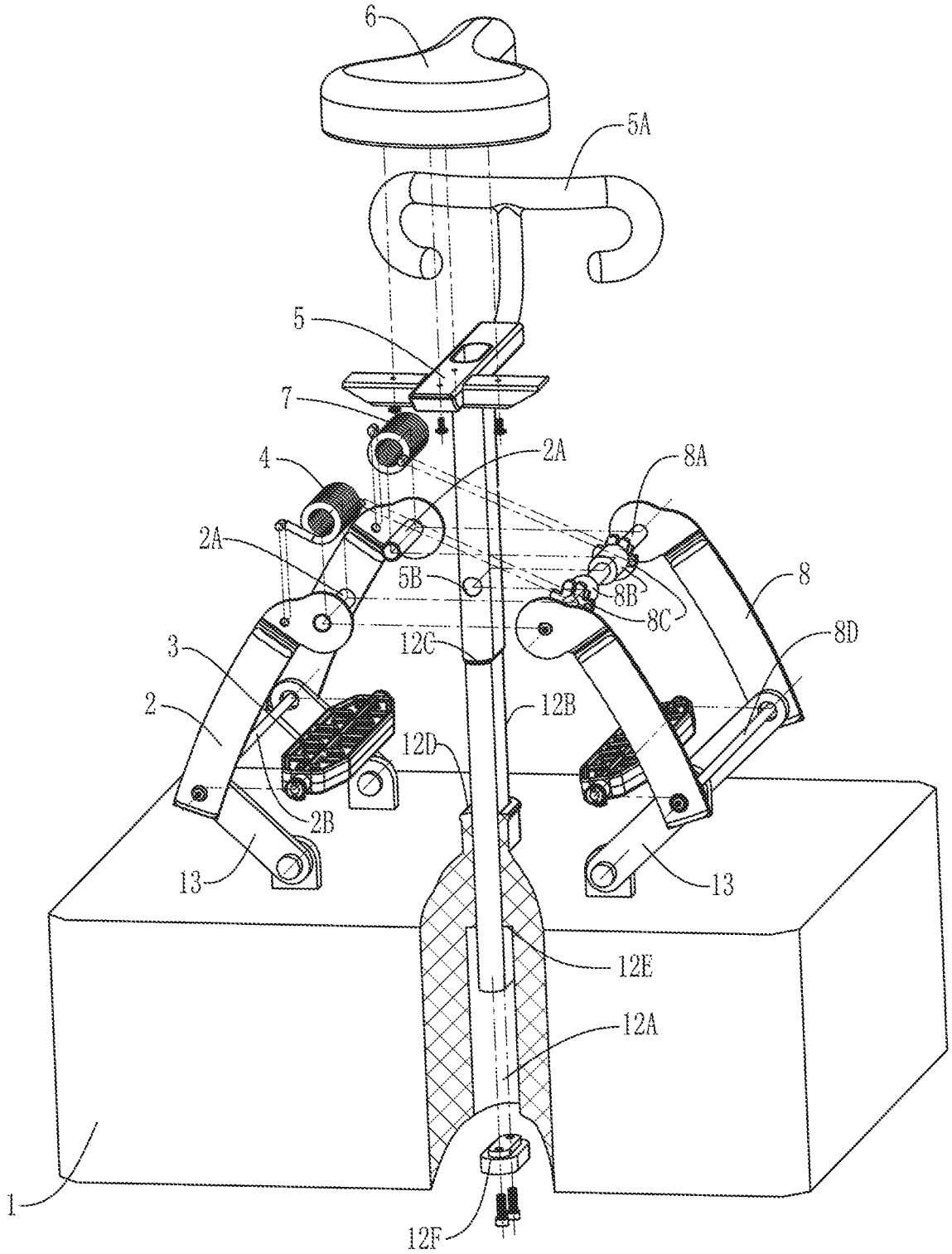
FIG. 7 is an exploded view of embodiment 3 of the present invention.
Figure 8:
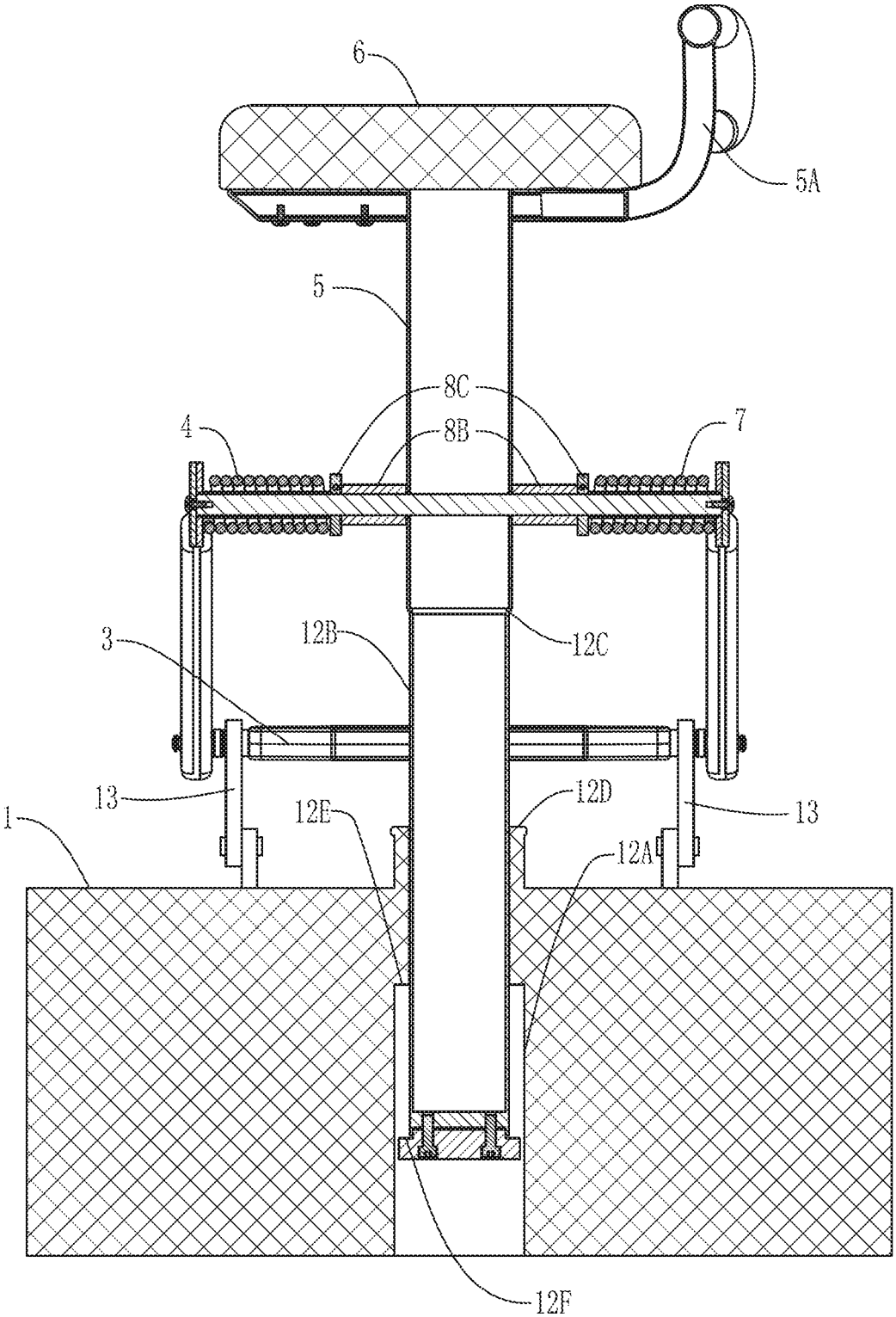
FIG. 8 is a cross-sectional view of embodiment 3 of the present invention.

As shown in FIGS. 6, 7, and 8, the "fitness stool" of the present invention mainly includes support and connection frame 5, a handle 5A, a seat cushion 6, a left wing plate 2, a footrest device 3, a torsion spring, a right wing plate 8, and a linkage mechanism 13. The ground 1 is provided with a sliding cavity 12A through which a sliding rod 12B disposed at a lower portion of the support and connection frame 5 passes, a lower limit lower portion 12D for preventing the support and connection frame 5 from colliding downwards with ground, and an upper limit upper portion 12E for preventing the support and connection frame 5 from coming off. An upper end of the support and connection frame 5 is provided with a seat cushion 6 and a handle 5A a lower portion is provided with a sliding rod 12B, and a middle portion is provided with a set of support and connection frame main holes 5B. A top end of the sliding rod 12B is provided with a lower limit upper portion 12C for preventing the support and connection frame 5 from colliding with ground, and a bottom end is provided with an upper limit lower portion 12F for preventing the support and connection frame 5 from coming off. The left wing plate 2 is composed of two legs (on both sides), a left wing plate upper sleeve 2A and a left wing plate lower shaft 2B, and the left wing plate lower shaft 2B is rotatably connected with the footrest device 3. The right wing plate 8 is composed of two legs (on both sides), a fixedly connected right wing plate upper shaft 8A and a right wing plate lower shaft 8D, the right wing plate upper shaft 8A is provided with two partition sleeves 8B and two shaft-locking clamps 8C, where the two shaft-locking clamps 8C are respectively fixedly connected to the right wing plate upper shaft 8A by bolts, the two shaft-locking clamps 8C are respectively provided with a hole for the torsion spring handle to be inserted into, and the right wing plate lower shaft D is rotatably connected with the footrest device 3. The right wing plate 8 is rotatably connected to the support and connection frame 5 via the right wing plate upper shaft 8A through the support and connection frame main hole 5B. The left wing plate 2 is inserted into the right wing plate upper shaft 8A through the left wing plate upper sleeve 2A and is rotatably connected to the right wing plate 8 and the support and connection frame 5, and it is ensured that the left wing plate 2 and the right wing plate 8 and the support and connection frame 5 can be rotated relative to each other. The first torsion spring 4 is set on the left wing plate upper sleeve 2A of the rear end, a handle of one end thereof passes into a hole provided on a rear leg of the left wing plate 2, and a handle of the other end thereof passes into a hole provided in the shaft-locking clamp 8C fixed at the rear end of the right wing plate upper shaft 8A The second torsion spring 7 is set on the left wing plate upper sleeve 2A at the front end, a handle of one end thereof passes into a hole provided on a front leg of the left wing 2, and a handle of the other end thereof passes into a hole provided in the shaft-locking clamp 8C fixed at the front end of the right wing plate upper shaft 8A for elastic return. Both sides of the left wing plate 2 and the right wing plate 8 are hinged on the linkage mechanism 13, and the other end of the linkage mechanism is hinged on the ground. The support and connection frame 5 passes into the sliding cavity 12A through the sliding rod 12B, and the lower limit lower portion 12D disposed on the ground 1 and the lower limit upper portion 12C disposed at a top end of the sliding rod 12B constitute a lower limit device for limiting over-sinking to collide with ground of the support and connection frame 5. The upper limit upper portion 12E provided on the ground 1 and the upper limit lower portion 12F disposed at a bottom end of the sliding rod 12B constitute an upper limit device for limiting excessively rising and disengaging of the support and connection frame 5, so that the body is relatively fixed on the ground 1, where the sliding cavity 12A, the sliding rod 12B, the lower limit upper portion 12C, the lower limit lower portion 12D, the upper limit upper portion 12E, and the upper limit lower portion 12F constitute a sliding system, which enables the support and connection frame 5 to be moved upwards and downwards relative to the ground 1 and ensures that the left wing plate 2 and the right wing plate 8 can be rotated and flapped relative to each other. In this system, the left wing plate 2, the torsion spring, the shaft-locking clamp 8C, the right wing plate upper shaft 8A, the right wing plate 8, the linkage mechanism constitutes an elastic device, which realizes an elastic damping on the mechanical relationship between the support and connection frame 5 and the ground 1 and an elastic return on the positional relationship, achieves fitness by motion upwards and downwards, and prevents the facility from shifting around to facilitate management thereof.

Embodiment 4

Figure 9:
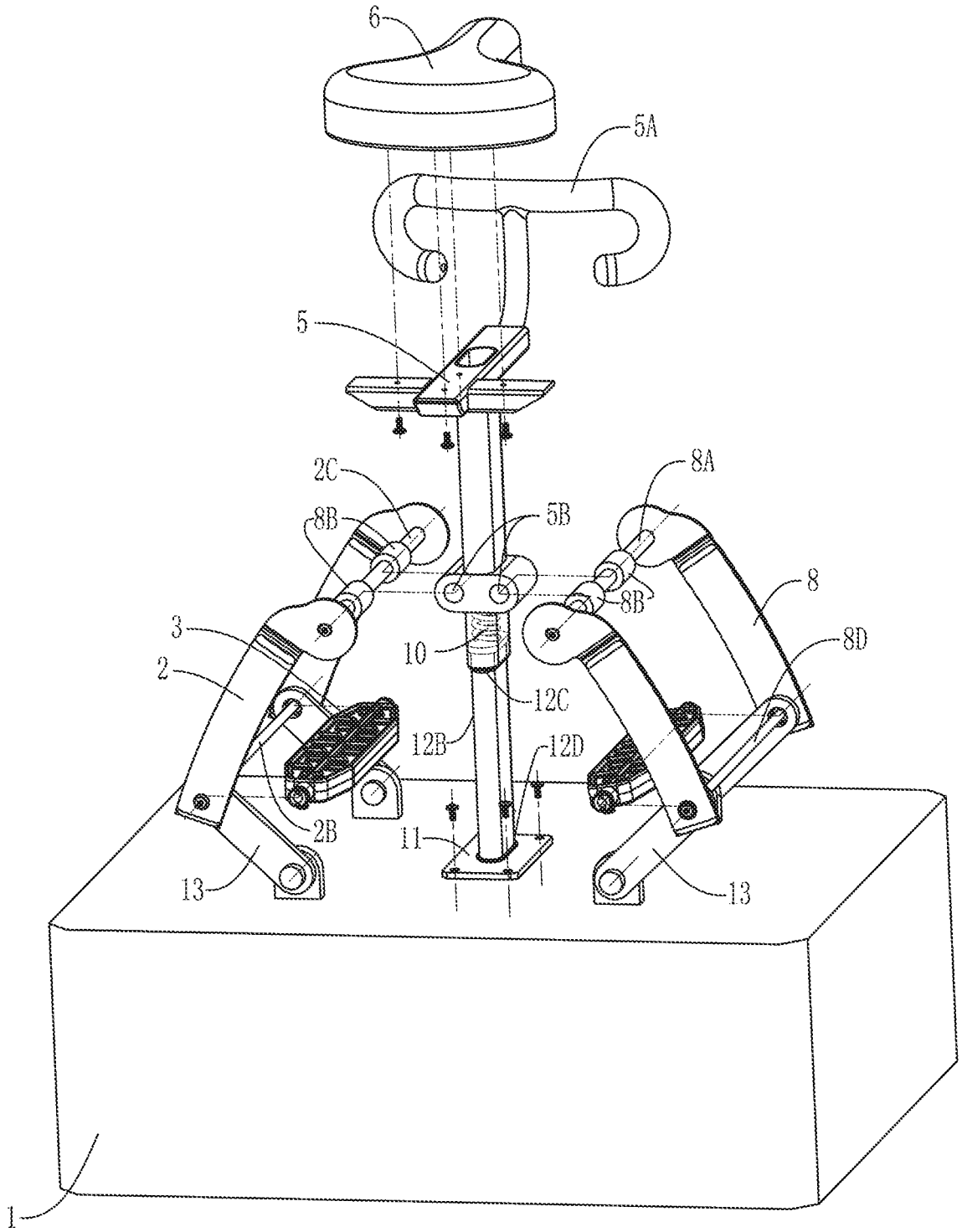
FIG. 9 is an exploded view of embodiment 4 of the present invention.

As shown in FIGS. 9 and 5, the "fitness stool" of the present invention mainly includes a ground 1, a support and connection frame 5, a left wing plate 2, a footrest device 3, a right wing plate 8, a linkage mechanism 11, a spring 10, and a connecting seat 11. The ground 1 is fixed with the connecting seat 11 by bolts, the connecting seat 11 is provided with a sliding rod 12B, the bottom of the sliding rod 12B is provided with a lower limit lower portion 12D, and the top of the sliding rod 12B is provided with an upper limit upper portion 12E. An upper portion of the support and connection frame is provided with a handle 5A and a seat cushion 6, and an inner portion is thereof is provided with is provided with a sliding cavity 12A through which a sliding rod 12B passes, a lower limit upper portion 12C for preventing the support and connection frame 5 from colliding downwards with ground, and an upper limit lower portion 12F for preventing the support and connection frame 5 from coming off Two sides at the middle part of the support and connection frame 5 are provided with two parallel sets of support and connection frame main holes 5B. The left wing plate 2 is composed of two legs (on both sides), a left wing plate upper shaft 2C and a left wing plate lower shaft 2B, the left wing plate upper shaft 2C is provided with two partition sleeves 8B, and the left wing plate lower shaft 2B is rotatably connected with the footrest device 3. In order to prevent injury of the foot of a rider, an angle control device is disposed between the left wing plate 2 and the footrest device 3 to limit their relative rotation within a certain angle range. The right wing plate 8 is composed of two legs (on both sides), a right wing plate upper shaft 8A and a right wing plate lower shaft SD, the right wing plate upper shaft 8A is provided with two partition sleeves 8B, the right wing plate lower shaft 8D is rotatably connected with the footrest device 3. An angle control device is disposed between the right wing plate 8 and the footrest device 3 to limit their relative rotation within a certain angle range. The right wing plate 8 is rotatably connected to the support and connection frame 5 via the right wing plate upper shaft 8A through the support and connection frame main hole 5B. The left wing plate 2 is inserted into the right wing plate upper shaft 8A through the left wing plate upper sleeve 2A and is rotatably connected to the right wing plate 8 and the support and connection frame 5, and in this way, the left wing plate 2 and the right wing plate 8 and the support and connection frame 5 can be rotated relative to each other. Both sides of the left wing plate 2 and the right wing plate 8 are hingedly connected with the linkage mechanism 13, and the other end of the linkage mechanism is hingedly connected with the ground. The connecting seat 11 is inserted into the sliding cavity 12A and connected to the support and connection frame 5 through the sliding rod 12B. The lower limit lower part 12D provided on the connection seat 11 and the lower limit upper part 12C at the lower end of the support and connection frame 5 constitute a lower limit device for limiting excessively rising and disengaging of the support and connection frame 5. The upper limit upper part 12E provided on the connection seat 1 and the upper limit lower portion 12F at the lower end of the sliding cavity 12A constitute an upper limit device for restricting the support and connection frame 5 from excessively rising and disengaging, so that the body is relatively fixed on the ground 1, where the sliding cavity 12A, the sliding rod 12B, the lower limit upper portion 12C, the lower limit lower portion 12D, the upper limit upper portion 12E, and the upper limit lower portion 12F constitute a sliding system, which enables the support and connection frame 5 to be moved upwards and downwards relative to the ground 1 and ensures that the left wing plate 2 and the right wing plate 8 can be rotated and flapped relative to each other. In this system, the spring 10, the connecting seat 11 constitutes the elastic device 14, which realizes an elastic damping on the mechanical relationship between the support and connection frame 5 and the ground 1 and an elastic return on the positional relationship, achieves fitness by motion upwards and downwards, and prevents the facility from shifting around to facilitate management thereof.

Embodiment 5

Figure 10:
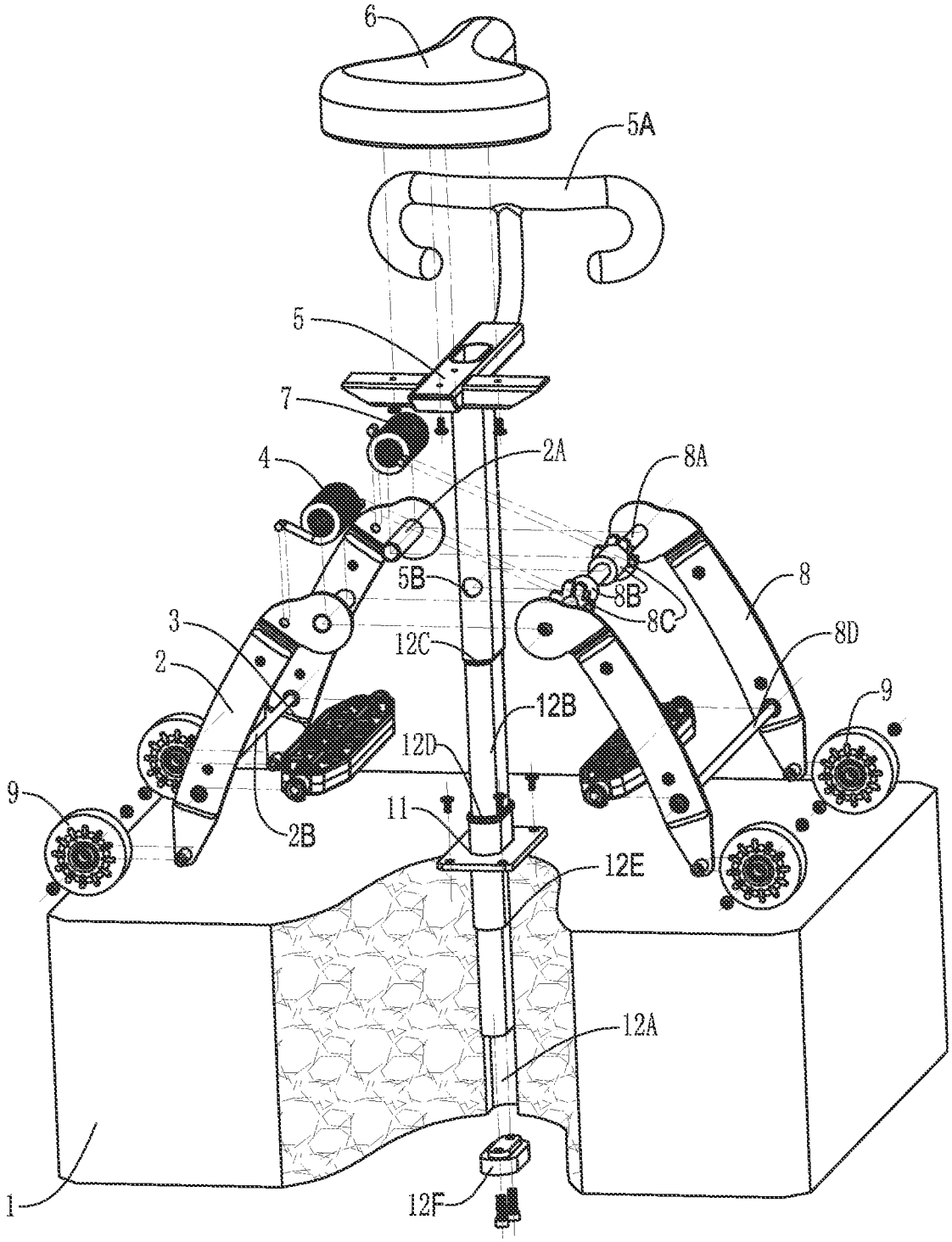
FIG. 10 is an exploded view of embodiment 5 of the present invention.
Figure 11:
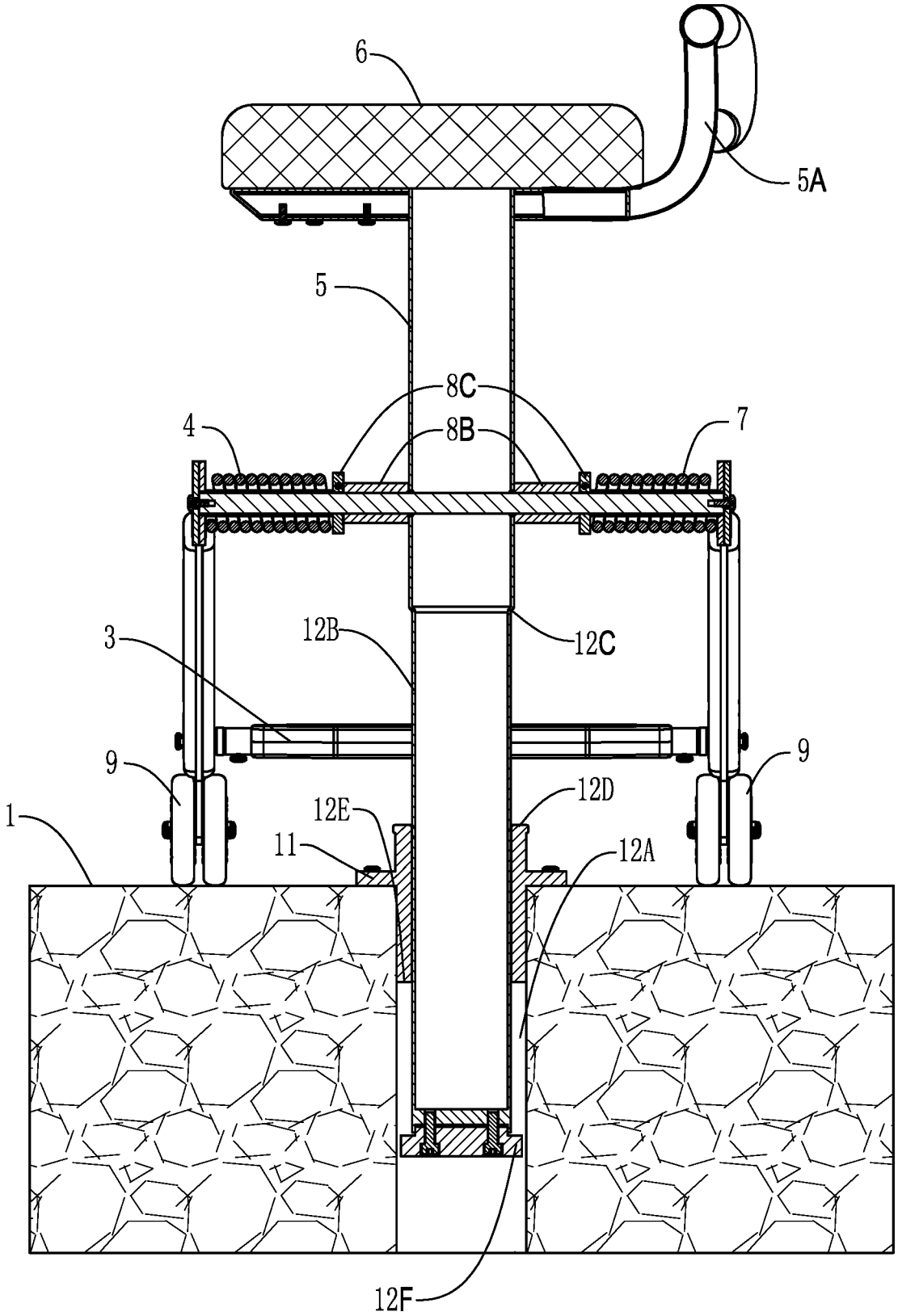
FIG. 11 is a cross-sectional view of embodiment 5 of the present invention.

As shown in FIGS. 10 and 11, the fitness stool of the present invention mainly includes a support and connection frame 5, a handle 5A, a seat cushion 6, a left wing plate 2, a footrest device 3, a torsion spring, a right wing plate 8, and a pulley device 9. A connection seat 11 is arranged on the ground 1, a pre-embedded portion is arranged under the connection seat 11, and the pre-embedded portion is pre-embedded in the ground 1. The connection seat 11 and the ground 1 are provided with a sliding cavity 12A through which a sliding rod 12B disposed at a lower portion of the support and connection frame 5 passes, a lower limit lower portion 12D for preventing the support and connection frame 5 from colliding downwards with ground, and an upper limit upper portion 12E for preventing the support and connection frame 5 from coming off. An upper end of the support and connection frame 5 is provided with a seat cushion 6 and a handle 5A, a lower portion is provided with a sliding rod 12B, and a middle portion is provided with a set of support and connection frame main holes 5B. A top end of the sliding rod 12B is provided with a lower limit upper portion 12C for preventing the support and connection frame 5 from colliding with ground, and a bottom end is provided with an upper limit lower portion 12F for preventing the support and connection frame 5 from coming off. The left wing plate 2 is composed of two legs (on both sides), a left wing plate upper sleeve 2A and a left wing plate lower shaft 2B, and the left wing plate lower shaft 2B is rotatably connected with the footrest device 3. The right wing plate 8 is composed of two legs (on both sides), a fixedly connected right wing plate upper shaft 8A and a right wing plate lower shaft 8D, the right wing plate upper shaft 8A is provided with two partition sleeves 8B and two shaft-locking clamps 8C, where the two shaft-locking clamps 8C are respectively fixedly connected to the right wing plate upper shaft 8A by bolts, the two shaft-locking clamps 8C are respectively provided with a hole for the torsion spring handle to be inserted into, and the right wing plate lower shaft 8D is rotatably connected with the footrest device 3. The right wing plate 8 is rotatably connected to the support and connection frame 5 via the right wing plate upper shaft 8A through the support and connection frame main hole 5B. The left wing plate 2 is inserted into the right wing plate upper shaft 8A through the left wing plate upper sleeve 2A and is rotatably connected to the right wing plate 8 and the support and connection frame 5, and it is ensured that the left wing plate 2 and the right wing plate 8 and the support and connection frame 5 can be rotated relative to each other. The first torsion spring 4 is screwed clockwise to sleeve on the left wing plate upper sleeve 2A of the rear end, a handle of one end thereof passes into a hole provided on a rear leg of the left wing plate 2, and a handle of the other end thereof passes into a hole provided in the shaft-locking clamp 8C fixed at the rear end of the right wing plate upper shaft 8A The second torsion spring 7 is screwed counterclockwise to sleeve on the left wing plate upper sleeve 2A at the front end, a handle of one end thereof passes into a hole provided on a front leg of the left wing 2, and a handle of the other end thereof passes into a hole provided in the shaft-locking clamp 8C fixed at the front end of the right wing plate upper shaft 8A for elastic return. The support and connection frame 5 passes into the sliding cavity 12A through the sliding rod 12B, and the lower limit lower portion 12D disposed on the top of the connection seat 11 and the lower limit upper portion 12C disposed at a top end of the sliding rod 12B constitute a lower limit device for limiting over-sinking to collide with ground of the support and connection frame 5. The upper limit upper portion 12E provided at the bottom of the connection seat 11 and the upper limit lower portion 12F disposed at a bottom end of the sliding rod 12B constitute an upper limit device for limiting excessively rising and disengaging of the support and connection frame 5, so that the body is relatively fixed on the ground 1, where the sliding cavity 12A, the sliding rod 12B, the lower limit upper portion 12C, the lower limit lower portion 12D, the upper limit upper portion 12E, and the upper limit lower portion 12F constitute a sliding system, which enables the support and connection frame 5 to be moved upwards and downwards relative to the ground 1 and ensures that the pulley device 9 can roll on the ground 1. In this system, the left wing plate 2, the torsion spring, the shaft-locking clamp 8C, the right wing plate upper shaft 8A, the right wing plate 8, the pulley device 9 constitutes an elastic device, which realizes an elastic damping on the mechanical relationship between the support and connection frame 5 and the ground 1 and an elastic return on the positional relationship, achieves fitness by motion upwards and downwards, and prevents the facility from shifting around to facilitate management thereof.

Certainly, there are many more specific implementation manners. For example, in the first, second, third, fourth and fifth embodiments, the handle 5A provided at the upper front end of the support and connection frame 5 can be provided at each of the front and rear ends, by which the same technical effect can be achieved. The spring in the second or the fourth embodiments can also be modified to the gas spring, or the left wing plate 2, the right wing plate 8, the pulley device 9, the linkage mechanism 13, and the footrest device 3 can all be eliminated, by which the same technical effect can be achieved. The details will not be described in the specification.

In the following, a specific operation method is briefly explained, taking embodiment 1 as an example: when operating, the user sits on the seat cushion 6, grasps the handle 5A by hand, and steps his or her foot on the footrest device 3; when the user retracts his or her legs and the whole weight is supported on the seat cushion 6, the stool body travels downwards, causing the lower limit upper part 12*c* to collide with the lower limit lower part 12D, the left wing plate 2 and the right wing plate 8 rotate relative to each other and expand, the left wing plate 2 drives a handle at one end of the first torsion spring 4 and the second torsion spring 7 to be twisted in the tightening direction, and the right wing plate 8 is rotated by the shaft 8A fixed on an upper end to drive the two shaft-locking clamps 8C fixed on the right wing plate upper shaft 8A to rotate, so as to respectively drive a handle at the other end of the first torsion spring 4 and the second torsion spring 7 to be twisted in the tightening direction, and in this way, potential energy is stored by the torsion spring. When the user stretches his or her legs, the force is pressed on the footrest device 3 and the handle 5A is lifted by both hands, and with the aid of the elastic return effect of the first torsion spring 4 and the second torsion spring 7, the user's gravity center is elevated, and the stool body travels upwards to the upper limit upper part 12E and collides with the upper limit lower part 12F to be stopped. This process is repeated, and the purpose of fitness is achieved. Also, in this way, the facility operates more stably and will not shift around, which is easy to manage.

It is to be understood that the foregoing is only preferred embodiments of the invention, and is not intended to limit the invention in any way. Those skilled in the art can make slight modifications or variations to the embodiments by using the above disclosure without departing from the technical scope of the present invention. Any simple changes, equivalent variations and modifications made to the above embodiments fall with the protection scope of the present invention.

What is claimed is:

1. A fitness stool, comprising:

a sliding system, a support and connection frame, a left wing plate and a right wing plate, and an elastic device, wherein the support and connection frame includes a seat cushion and at least a first handle adjacent to a first side of the seat cushion and is configured to be moveably restrained with respect to a ground by the sliding system, the support and connection frame can be driven to move upwards and downwards relative to the ground, the sliding system comprising a sliding rod and a structure comprising a sliding cavity, and the elastic device is provided between the ground and the support and connection frame, for ensuring that the support and connection frame together with the seat cushion and the handle can drive the elastic device to elastically deform and allow the elastic device to reset when moving up or down relative to the ground, wherein the support and connection frame comprises at least one of the sliding rod and the structure comprising the sliding cavity, and wherein an upper part of each of the left and right wing plates is respectively rotatably connected to the sliding system and lower parts of each of the left and right wing plates is respectively distributed on both sides of the sliding system at a substantially symmetrical angle relative to the sliding system, for ensuring that the support and connection frame together with the seat cushion and the handle can move upwards when the left and right wing plates are rotated closer to the sliding system and can move downwards when the left and right wing plates are rotated farther away relative to the sliding system.

2. The fitness stool according to claim 1, wherein a linkage mechanism is disposed between the left and the right wing plates and the ground.

3. The fitness stool according to claim 2, wherein one end of the linkage mechanism is hinged at the left wing plate or the right wing plate and the other end of the linkage mechanism is hinged to the ground.

4. The fitness stool according to claim 1, wherein a second handle is arranged adjacent to a second side opposite to the first side of the seat cushion.

5. The fitness stool according to claim 1, wherein further comprising two footrest devices which each is connected to one of the respective wing plates and the linkage mechanisms.

6. The fitness stool according to claim 5, wherein each of the left and right wing plates comprises two legs, an upper shaft, and a lower shaft, the lower shaft is rotatably connected with one of the respective footrest devices.

* * * * *